US007735277B1

(12) United States Patent
Everhart et al.

(10) Patent No.: US 7,735,277 B1
(45) Date of Patent: Jun. 15, 2010

(54) SIMULATED BRICK BUILDING PANEL

(76) Inventors: Clint Everhart, P.O. Box 632, Bryant, AR (US) 72089; Chuck Cole, 972 Shiloh Rd., Bedee, AR (US) 72012

( * ) Notice: Subject to any disclaimer, the term of this patent is extended or adjusted under 35 U.S.C. 154(b) by 29 days.

(21) Appl. No.: 12/026,621

(22) Filed: Feb. 6, 2008

(51) Int. Cl.
*E04C 1/00* (2006.01)
*E04D 1/00* (2006.01)
*B44F 9/00* (2006.01)

(52) U.S. Cl. ..... 52/314; 52/555; 52/316

(58) Field of Classification Search ..... 52/314, 52/316, 555, 315
See application file for complete search history.

(56) References Cited

U.S. PATENT DOCUMENTS

| | | | | | |
|---|---|---|---|---|---|
| 1,871,887 | A | * | 8/1932 | Jasinski | 427/204 |
| 1,947,271 | A | * | 2/1934 | Mattison | 427/272 |
| 2,021,577 | A | * | 11/1935 | Odell | 52/314 |
| 2,095,642 | A | * | 10/1937 | Knight | 427/264 |
| 2,115,172 | A | * | 4/1938 | Kirschbraun | 52/519 |
| 2,135,572 | A | * | 11/1938 | Fried | 52/314 |
| 2,139,620 | A | * | 12/1938 | Kirschbraun | 52/314 |
| 2,156,566 | A | * | 5/1939 | Kirschbraun | 52/591.4 |
| 2,164,725 | A | * | 7/1939 | Snyder | 52/314 |
| 2,178,535 | A | | 10/1939 | Willson | |
| 2,221,475 | A | * | 11/1940 | Goldschmidt, Sr. | 52/314 |
| 2,224,351 | A | * | 12/1940 | Kaye | 52/314 |
| 2,245,047 | A | * | 6/1941 | Odell | 52/314 |
| 2,246,377 | A | * | 6/1941 | Mattes | 52/314 |
| 2,260,334 | A | * | 10/1941 | Phillips | 52/314 |
| 2,270,808 | A | * | 1/1942 | Kaye | 52/314 |
| 2,419,047 | A | * | 4/1947 | Young | 52/314 |
| 2,660,217 | A | * | 11/1953 | Lawson | 156/212 |
| 3,177,279 | A | | 4/1965 | Bilodeau | |
| 3,552,987 | A | * | 1/1971 | Smith | 427/197 |
| 3,882,218 | A | | 5/1975 | Bixel, Jr. | |
| 4,044,520 | A | * | 8/1977 | Barrows | 52/309.12 |
| 4,164,598 | A | * | 8/1979 | Wilhelm | 428/48 |
| 4,241,554 | A | * | 12/1980 | Infantino | 52/314 |
| 4,296,154 | A | * | 10/1981 | Ibberson | 428/15 |
| 4,349,588 | A | * | 9/1982 | Schiffer | 427/230 |
| 4,363,145 | A | * | 12/1982 | Kawesch | 4/583 |
| 4,510,729 | A | | 4/1985 | Syring | |
| 4,859,504 | A | * | 8/1989 | Rossiter et al. | 427/262 |
| 4,975,303 | A | | 12/1990 | McKinnon | |
| 5,502,941 | A | | 4/1996 | Zember et al. | |
| 5,787,666 | A | | 8/1998 | Sherry | |
| 6,395,384 | B1 | * | 5/2002 | Adam | 428/319.3 |
| 6,539,643 | B1 | * | 4/2003 | Gleeson | 33/563 |
| 2003/0046891 | A1 | * | 3/2003 | Colada et al. | 52/518 |
| 2006/0174585 | A1 | * | 8/2006 | Barr | 52/741.3 |
| 2007/0042192 | A1 | * | 2/2007 | Nguyen et al. | 428/420 |
| 2007/0147958 | A1 | * | 6/2007 | Rossi | 404/75 |
| 2007/0261353 | A1 | * | 11/2007 | Cullen | 52/590.2 |

FOREIGN PATENT DOCUMENTS

| | | |
|---|---|---|
| GB | 1.240.041 | 7/1971 |
| JP | 2000120248 | 4/2000 |

* cited by examiner

*Primary Examiner*—Robert J Canfield
*Assistant Examiner*—Babajide Demuren
(74) *Attorney, Agent, or Firm*—Michael I. Kroll

(57) ABSTRACT

A cementitious fiberboard sprayed with an acrylic sand composition and enamel spray paint which is then tooled to a brick-looking face. Variations in the brick-like color and texture are provided by varying the acrylic paint color and sand particle size and density.

10 Claims, 12 Drawing Sheets

STEPS TO THE PROCESS OF CREATING THE PRESENT INVENTION.

STEPS TO PREPARE A CONCRETE FOOTING

STEPS TO THE PROCESS OF CREATING THE PRESENT INVENTION.

Substitute Sheet

SIMULATED BRICK BUILDING PANEL

BACKGROUND OF THE INVENTION

1. Field of the Invention

The present invention relates generally to fabricated panels and, more specifically, to a cementitious fiberboard sprayed with an acrylic sand composition and enamel spray paint which is then tooled to a brick-looking face. Variations in the brick-like color and texture are provided by varying the acrylic paint color and sand particle size and density.

2. Description of the Prior Art

There are other fabricated panels' designed as building materials. Typical of these is U.S. Pat. No. 2,178,535 issued to Willson on Oct. 31, 1939.

Another patent was issued to Bilodeau on Apr. 6, 1965 as U.S. Pat. No. 3,177,279. Yet another U.S. Pat. No. 3,882,218 was issued to Bixel, Jr. on May 6, 1975 and still yet another was issued on Aug. 14, 1979 to Wilhelm as U.S. Pat. No. 4,164,598.

Another patent was issued to Schiffer on Sep. 14, 1982 as U.S. Pat. No. 4,349,588. Yet another U.S. Pat. No. 4,510,729 was issued to Syring on 4,510,729. Another was issued to McKinnon on Dec. 4, 1990 as U.S. Pat. No. 4,975,303 and still yet another was issued on Apr. 2, 1996 to Zember et al. as U.S. Pat. No. 5,502,941.

Another patent was issued to Sherry on Aug. 4, 1998 as U.S. Pat. No. 5,787,666. Yet another Japan Patent No. JP2000120248 was issued to Nakama on Apr. 25, 2000. Another was issued to Moore et al. on Jul. 21, 1971 as U.K. Patent No. GB 1240041.

U.S. Pat. No. 2,178,535

Inventor: Lester E. Willson

Issued: Oct. 31, 1939

A form for molding a concrete wall provided with strips of resilient material arranged in parallel relation on its inner face for removably holding individual tiles thereon, said strips being positioned and dimensioned to yield to admit the tiles between them so as to exert pressure from opposite directions against the tiles by engagement with the edge surfaces thereof which extend transversely of their exposed faces in the finished wall, whereby said resilient strips act frictionally to retain the tiles on the form, and removable spacer strips dimensioned to fit between adjacent strips of the parallel series for spacing the tiles from each other.

U.S. Pat. No. 3,177,279

Inventor: Robert J. Bilodeau

Issued: Apr. 6, 1965

A method of forming a decorative building panel that will have an exterior surface simulating in relief true reproductions of a plurality of shapes bonded by mortar joints consisting essentially of the following steps:

(a) providing a resilient mold which contains a portion having impressions of shapes, complementary ridges and undercuts (b) applying to the surface of said mold a layer consisting of a polymerizable resin, a polymerization catalyst, a colorant and rock particles, which first layer when polymerized becomes solidified;

(c) spraying on the surface of said first layer a second layer consisting essentially of a polymerizable resin, a polymerization catalyst, and a plurality of randomly oriented fiber glass strands, which second layer when polymerized becomes bonded to the first layer;

(d) polymerizing said two layers to solidify them into an integral panel;

(e) stripping said mold from said panel;

(f) and, dusting the exterior surface of the panel with rock dust to give a dull finish thereto.

U.S. Pat. No. 3,882,218

Inventor: Charles G. Bixel, Jr.

Issued: May 6, 1975

Base Building panels, which have been cut from large blocks of expanded, high-density, foamed plastic, include an array of grooves which, together with the non-grooved areas of the panels simulate the desired brick-and-mortar appearance, the grooves having been formed by an appropriate array of heating elements. The panels may be utilized as skirting or underpinning for mobile homes so as to present a permanent foundation appearance for the home. To install the panels, small blocks of expanded, high-density, foamed plastic are bonded to the back surfaces of the panels so as to provide a panel interlock mechanism. A perimetrical trench is excavated beneath the exterior wall surfaces of the mobile home, whereupon the bottom edge portions of the panels are inserted within the trench, while the upper edge portions are secured to the mobile home undersurface by means of additional small blocks of foamed plastic which have been coated with plastic adhesive. Access panels and ventilation means may be inserted within the skirt enclosure, and the enclosure may be painted a particular color or a multitude of colors according to a particular design.

U.S. Pat. No. 4,164,598

Inventor: William D. Wilhelm

Issued: Aug. 14, 1979

A veneer wall covering to simulate a brick wall through the provision of adhering a plurality of thin blocks formed from dry wall sheet stock to an interior wall in any known brick layup patterns, applying a coating over the blocks to produce a textured surface which duplicates the texture of bricks, followed by applying a desired color selected from the prevailing color or real brick, or variations thereof.

U.S. Pat. No. 4,349,599

Inventor: Henry Schiffer

Issued: Sep. 14, 1982

A method for making simulated brick or tile wall or floor using cement, water-based adhesive and water-insoluble powdered pigment. The mixture is applied and then partially set. Scoring indentations are made to remove cement. After being completely set, mortar is placed in the indentations as a grout and allowed to set. The final step is a clear water-resistant coating on the entire surface.

U.S. Pat. No. 4,510,729

Inventor: Ewald Syring

Issued: Apr. 16, 1985

It is the object of the invention to give also the non-professional the possibility to apply, by means of this method and a template, mineral plaster in the form of clinker plastering to a wall surface. To this end a template with a network corresponding to joints and made of impregnated cardboard is applied to a continuous carrier film by means of a non-hardening adhesive, and is folded in zig-zag form. The network is removed from the carrier film and stuck to the same extent to a wall surface. Afterwards the mineral plaster is applied to the wall surface. After removing the network a clinker or brickwork like structure is attained. In the spray rendering method embodiment the network is made of paper-thin, tension-resistant material. The network and carrier film are then rolled up in a roll.

U.S. Pat. No. 4,975,303

Inventor: Gordon McKinnon

Issued: Dec. 4, 1990

A process for covering a substrate with a textured simulated marble surface and the resulting product. Cement and sand are mixed to form a first mixture to which is added an aqueous solution of an adhesive resin such as an acrylic resin to create a mortar. The mortar is spread on the substrate and one or more color pigments are added to the surface at randomly-spaced locations prior to the complete curing of the mortar. Air is blown onto the surface of the mortar and serves to blend the color pigments into the mortar and into each other. As the air stream moves across the surface of the mortar, color patterns are formed.

U.S. Pat. No. 5,502,941

Inventor: Louis F. Zember et al.

Issued: Apr. 2, 1996

An ornamental coating and process for applying the coating to a substrate includes mixing a first batch of liquid mortar composed of sand, cement and an aqueous solution of acrylic resin, and trowelling or spraying a first layer of the liquid mortar onto the substrate and allowing the liquid mortar to cure. A second batch of liquid mortar is mixed which is the same as the first except that it contains a color pigment contrasting with the color of the first batch. A template defining a pattern of grout lines is placed over the cured first batch and the second batch of liquid mortar is trowelled or sprayed over the first batch and the template as a second layer and allowed to cure only to the extent that the second layer is firm, but not hard. The template is then removed, removing that part of the second layer immediately above the template thus exposing lines of the cured first batch which then appear as grout lines between areas of colored mortar which appear as bricks, flagstone or tiles etc. When the second batch has completely cured, two layers of concrete sealer are applied.

U.S. Pat. No. 5,787,666

Inventor: Edward B. Sherry

Issued: Aug. 4, 1998

A system of light weight, high strength, thin masonry panels having one or more mateable seam hiding edges. The seam hiding edge may be serpentine or some other shape consistent with the masonry element chosen for the panel surface. The aforementioned thin masonry panels are used to construct patio or walkway surfaces as well as provide a decorative facing for walls, fireplaces, and the like. The thickness of the panels is limited to the range of 1 to 2 inches in order to assure a light weight for ease of construction. Each panel is a reinforced series of masonry elements such as stone or brick pavers bound together by a cement or mortar-like material. The claimed invention also includes an attachment plate for affixing the panels to other surfaces and structures.

Japan Patent Number JP2000120248

Inventor: Nakama Yasuhiro

Issued: Apr. 25, 2000

PROBLEM TO BE SOLVED: To provide a wall panel having a pattern arranged with a plurality of brick, stone, tile or the like particularly with simple work for jointing together a plurality of wall panels having good appearance with the joints simulating brick joints. SOLUTION: A wall panel 1 for architectural decoration has a pattern of a plurality of sequentially stacked or adhered brick, stone, tile or the like provided with symmetrical stepwise projected portions at the left edge 4 and right edge 5 in such a manner that both the edges can be mutually interlocked, and projected ribs 6 or recessed stripes 7 are provided at predetermined position of this stepwise projected portions in configuration.

U.K. Patent Number GB1240041

Inventor: Michael Frank Moore et al.

Issued: Jul. 21, 1969

A brick tile is produced by cutting a thick layer from the surface of a fired clay brick so that it has one natural face and one plain flat face for adhesively securing to a wall surface. Opposite faces of a brick may be cut off to give two tiles. A number of the elements may be assembled together as a panel before application to a wall.

While these fabricated panels may be suitable for the purposes for which they were designed, they would not be as suitable for the purposes of the present invention, as hereinafter described.

SUMMARY OF THE PRESENT INVENTION

A primary object of the present invention is to provide a simulated brick-like building panel.

Another object of the present invention is to provide a simulated brick-like building panel using fiber cement board as the base material providing a building panel that is durable, resistive to weathering, insects and vermin.

Yet another object of the present invention is to provide a simulated brick-like building panel using fiber cement board that is treated on one side with an acrylic paint and sand mixture to simulate a brick-like finish.

Still yet another object of the present invention is to provide a brick-like building panel wherein the treated side is highlighted with an enamel paint to enhance the brick-like appearance.

Another object of the present invention is to provide a brick-like building panel wherein the brick-like panel is tooled to simulate the mortar-like spacing between laid bricks.

Yet another object of the present invention is to provide a brick-like building panel where the fiber cement board once treated is scored through the enamel, acrylic paint and sand composition to a depth to give the appearance of brick interdisposed motar.

Still yet another object of the present invention is to provide a brick-like building panel having opposing edges scored on opposing sides whereby a plurality of said panels can be assembled with an overlap from panel to panel.

Another object of the present invention is to provide a brick-like building panel that requires no special tools for assembly.

Yet another object of the present invention is to provide a brick-like building panel that can be used as a skirt for modular homes.

Still yet another object of the present invention is to provide a brick-like building panel that can be used in place of laid bricks thereby obviating the need for a foundation footing.

Additional objects of the present invention will appear as the description proceeds.

The present invention overcomes the shortcomings of the prior art by providing a cementitious fiberboard sprayed with an acrylic sand composition and enamel spray paint which is then tooled to a brick-looking face. Variations in the brick-like color and texture are provided by varying the acrylic paint color and sand particle size and density.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

DESCRIPTION OF THE REFERENCED NUMERALS

Figure 1:
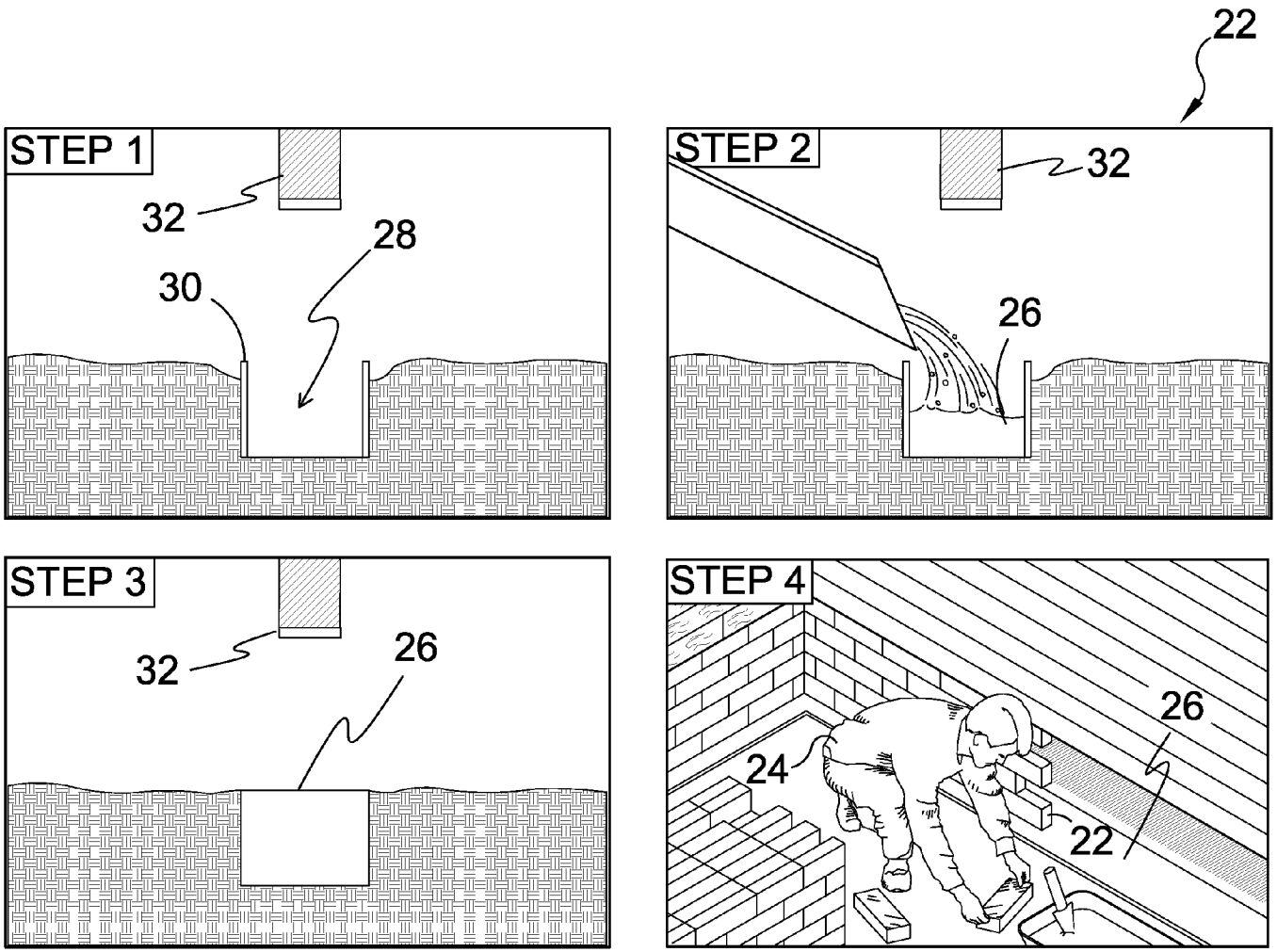
FIG. 1 (PRIOR ART)
FIG. 1 is an illustrative view of prior art.

Turning now descriptively to the drawings, in which similar reference characters denote similar elements throughout the several views, the figures illustrate the Simulated Brick Building Panel of the present invention. With regard to the reference numerals used, the following numbering is used throughout the various drawing figures.

10 Simulated Brick Building Panel of the present invention
12 fiber cement board
14 acrylic paint and sand mixture
16 enamel paint
18 faux mortar line
20 prior art
22 brick and mortar cement siding
24 brick layer
26 concrete footing
28 trench
30 footing support
32 mobile building structure
34 axle of 32
36 hydraulic support
38 vertically overlapped joint
40 overlap of 38
42 underlap of 38
44 installer
46 nailer
48 gang saw cut
50 quick brick foundation facing
52 first coarse
54 second coarse
56 classic red finish
58 rustic brown finish

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of prior art 20. Conventional brick and fiber cement siding 22 have been around for a long time. They are costly and a time consuming job that must be installed by an experienced bricklayer 24 and also require a concrete footing 26 in a trench 28 with footing supports 30. Shown is a bricklayer 24 installing brick and mortar siding 22 under a prefab house 32. The present invention overcomes this problem by providing a simulated brick siding that installs with basic carpentry skills and is cost effective and does not require a concrete footing.

Figure 2:
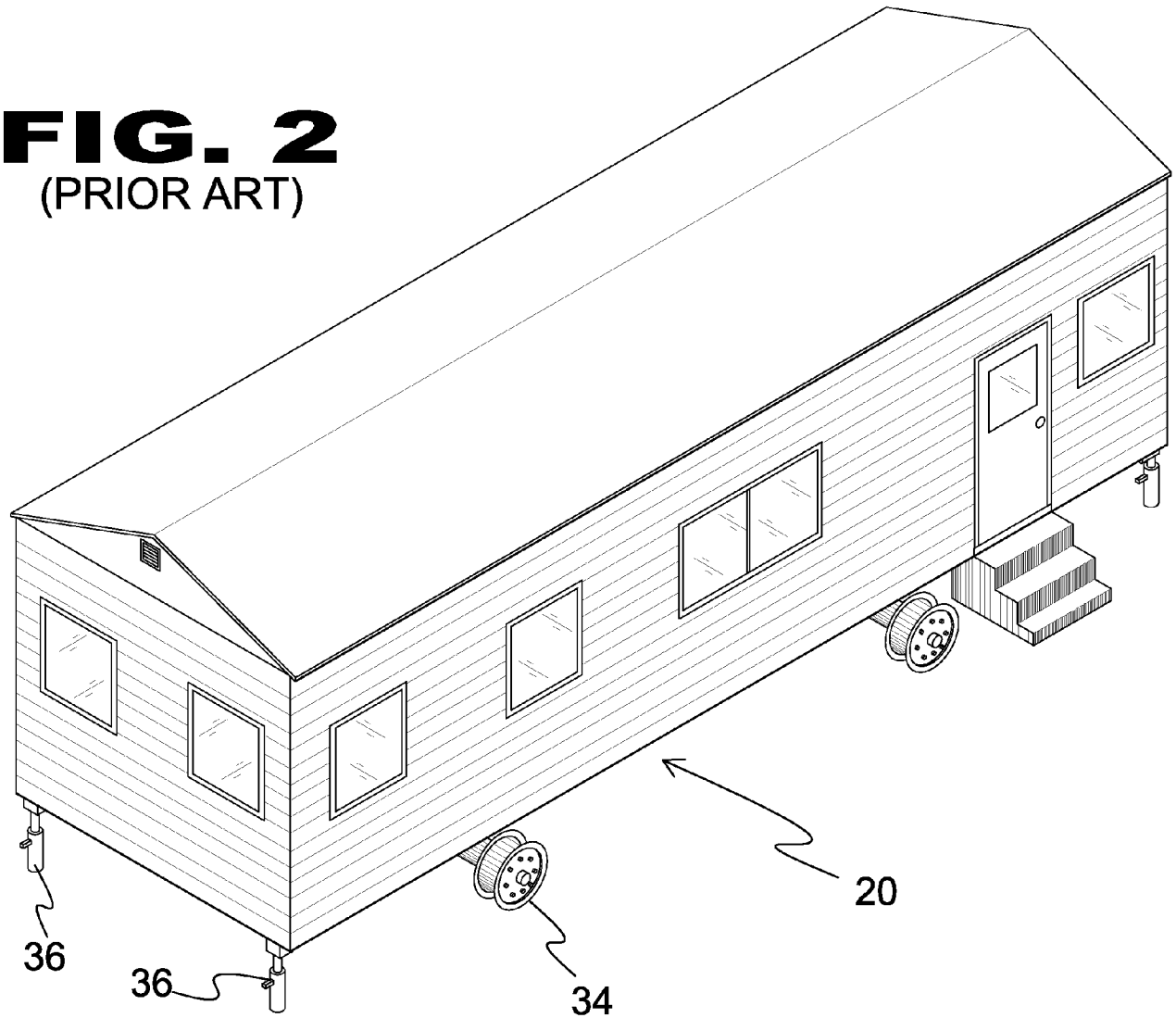
FIG. 2 (PRIOR ART)
FIG. 2 is an illustrative view of prior art.

FIG. 2 is an illustrative view of prior art 20. Shown is a trailer type home 32 having no skirting around the open base of the trailer. The axle 34 and hydraulic supports 36 are visible and the open space allows access to animals, rodents, bugs and other critters.

Figure 3:
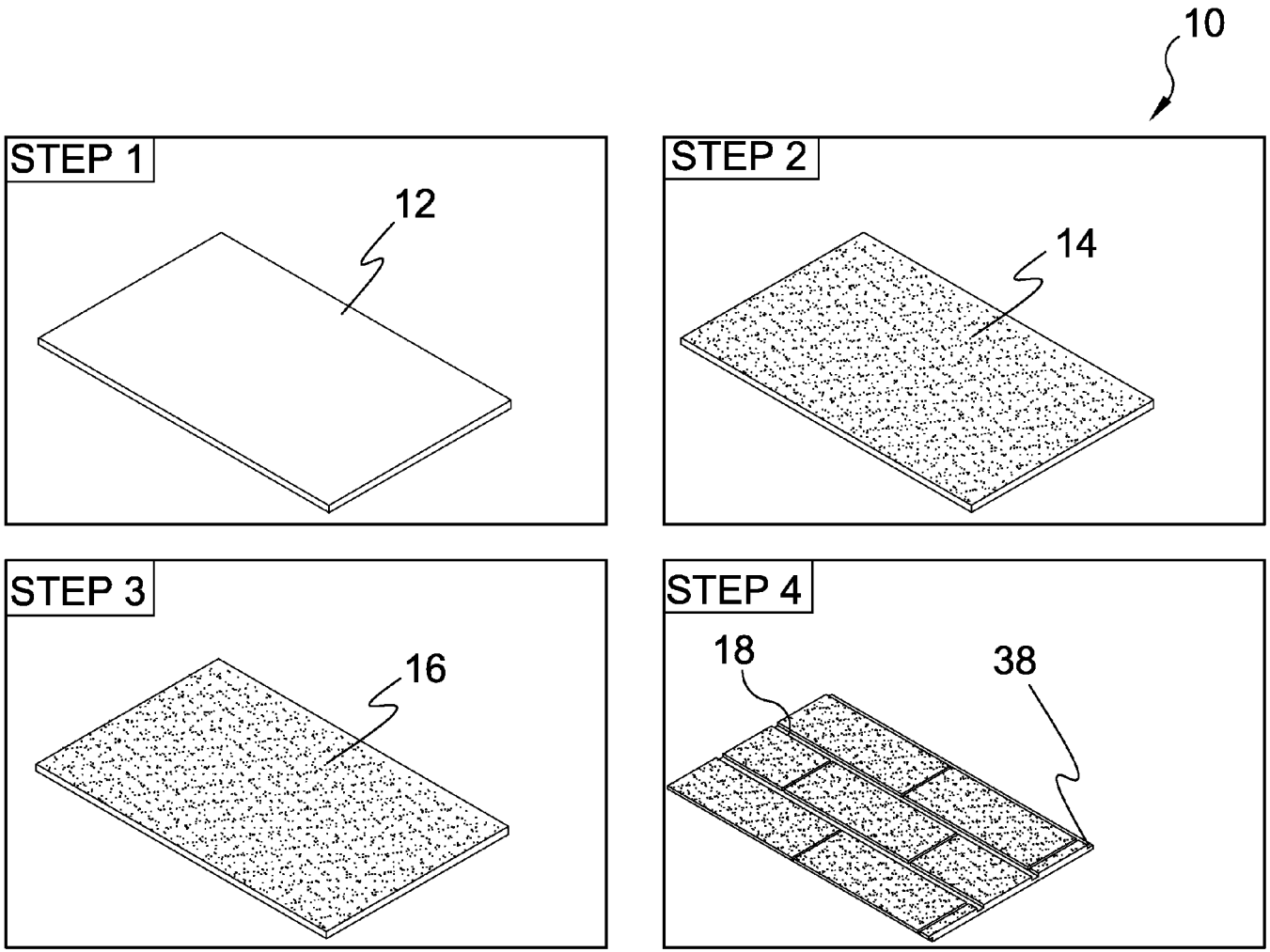
FIG. 3 is an illustrative view of the present invention in use.

FIG. 3 is an illustrative view of the present invention 10 in use. The present invention 10 is a fiber cement board 12 coated with a brick finish and cut with a modular brick pattern. The process of creating the fiber cement board 12 of the present invention 10 is the fiber cement board 12 sprayed with a mixture of 100% acrylic paint mixed with sand 14 for texture. Then the board is highlighted with the brick look using enamel spray paint 16. The faux mortar lines 18 defining the brick pattern is sawed, using a gang saw. The vertically overlapped joints 38 are then hand cut using a grinder. The board is washed down and is now ready for installation.

Figure 4:
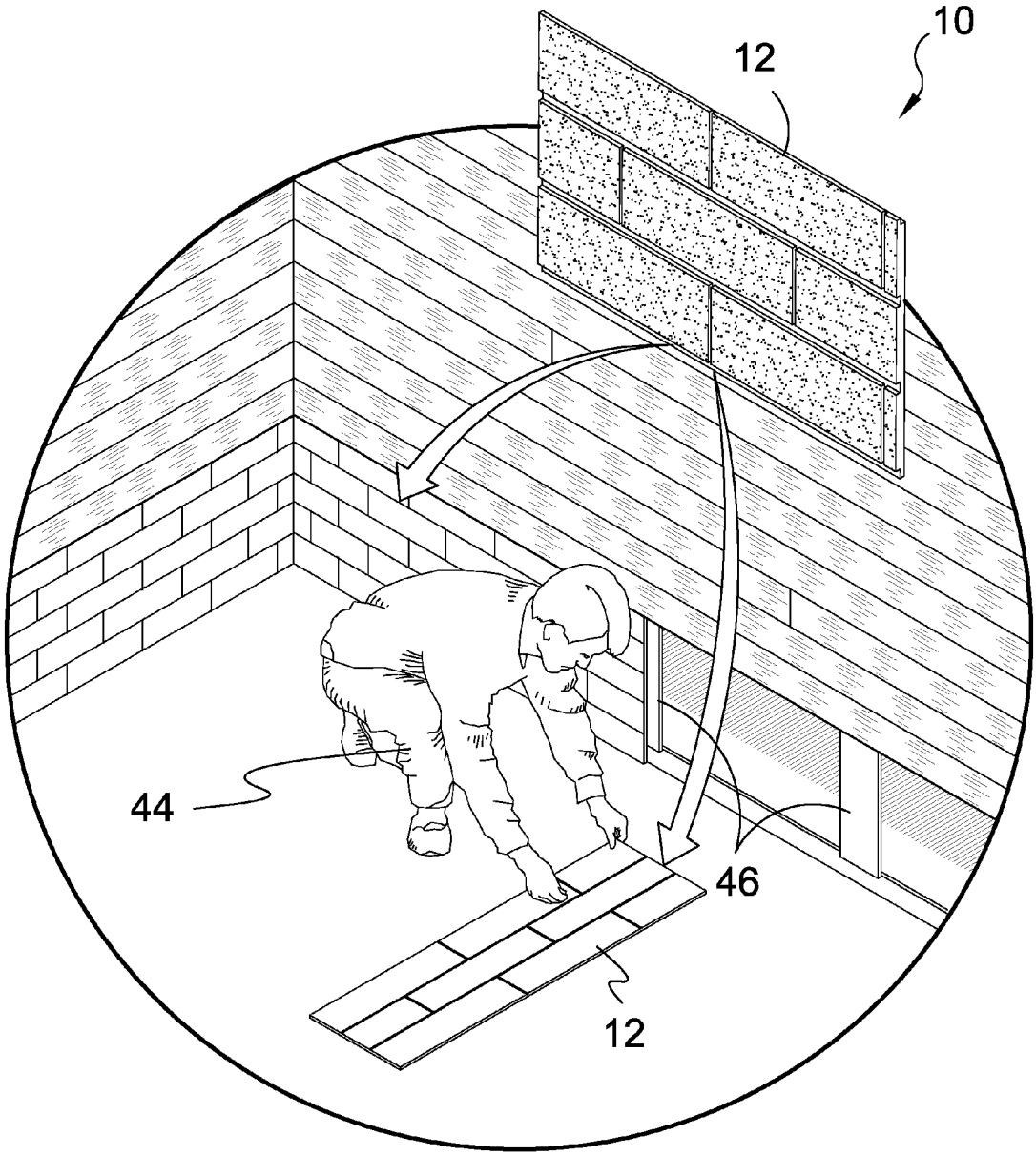
FIG. 4 is an illustrative view of the present invention in use.

FIG. 4 is an illustrative view of the present invention in use. Shown is the installer 44 preparing the fiber cement board 12 for installation using basic carpentry skills. The finished boards 12 are secured to nailers 46 with fastening elements such as nails or screws.

Figure 5:
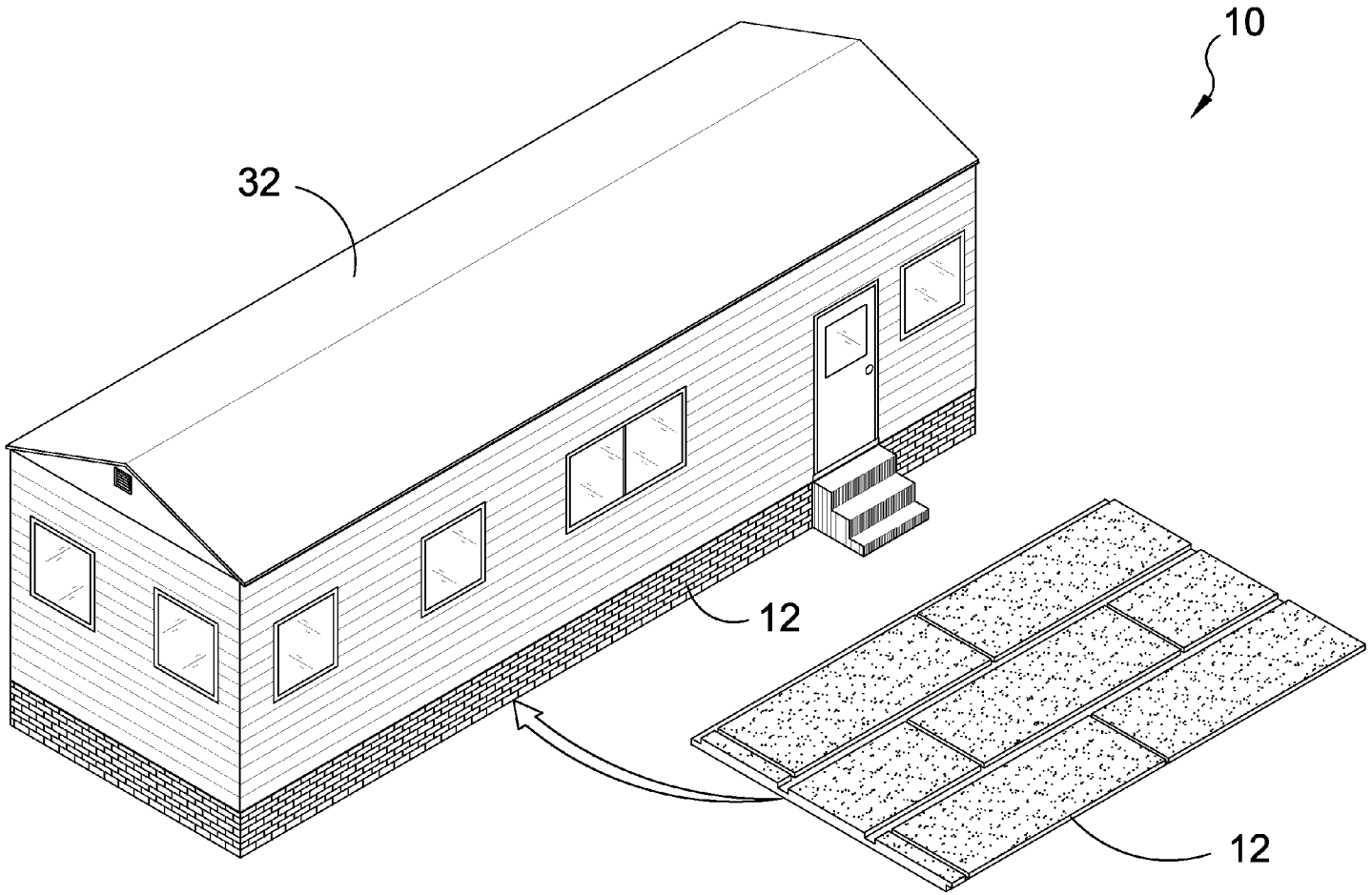
FIG. 5 is an illustrative view of the present invention in use.

FIG. 5 is an illustrative view of the present invention 10 in use. Shown is the present invention in use on a trailer type home 32. The cement board 12 skirting of the present invention 10 hides the trailers 32 under side equipment such as axles and hydraulic supports, adding elegance and increasing the value of the home. The skirting also prevents critters from finding habitat under the home.

Figure 6:
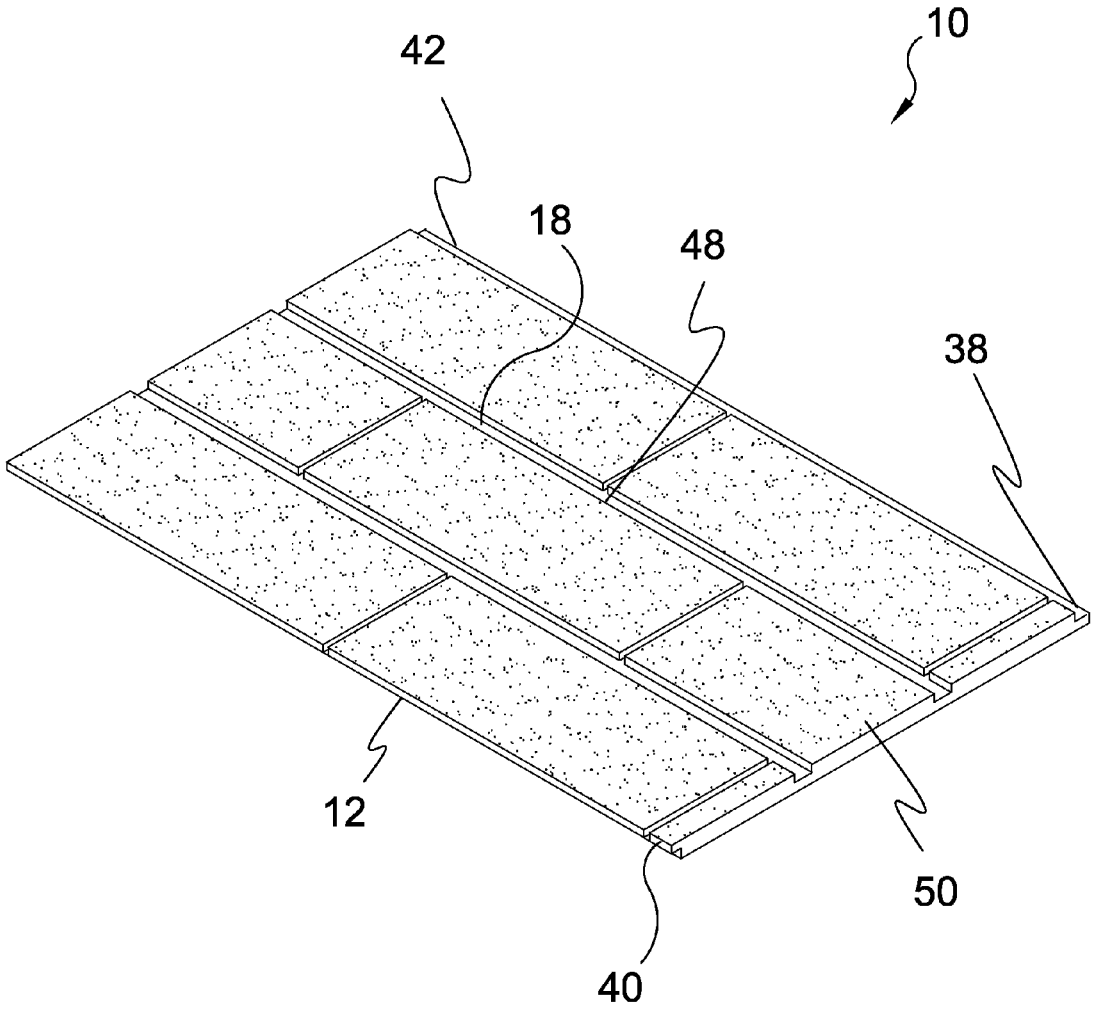
FIG. 6 is a perspective view of one tile of the present invention.

FIG. 6 is a perspective view of one tile of the present invention 10. The faux mortar lines 18 defining the brick pattern of the quick brick foundation facing 50 are made with gang saw cuts 48. The vertically overlapped joints 38 of the board 12 are then hand cut using a grinder to form an overlap 40 on one edge and an underlap 42 at the opposing edge. The board is washed down and is ready for installation.

Figure 7:
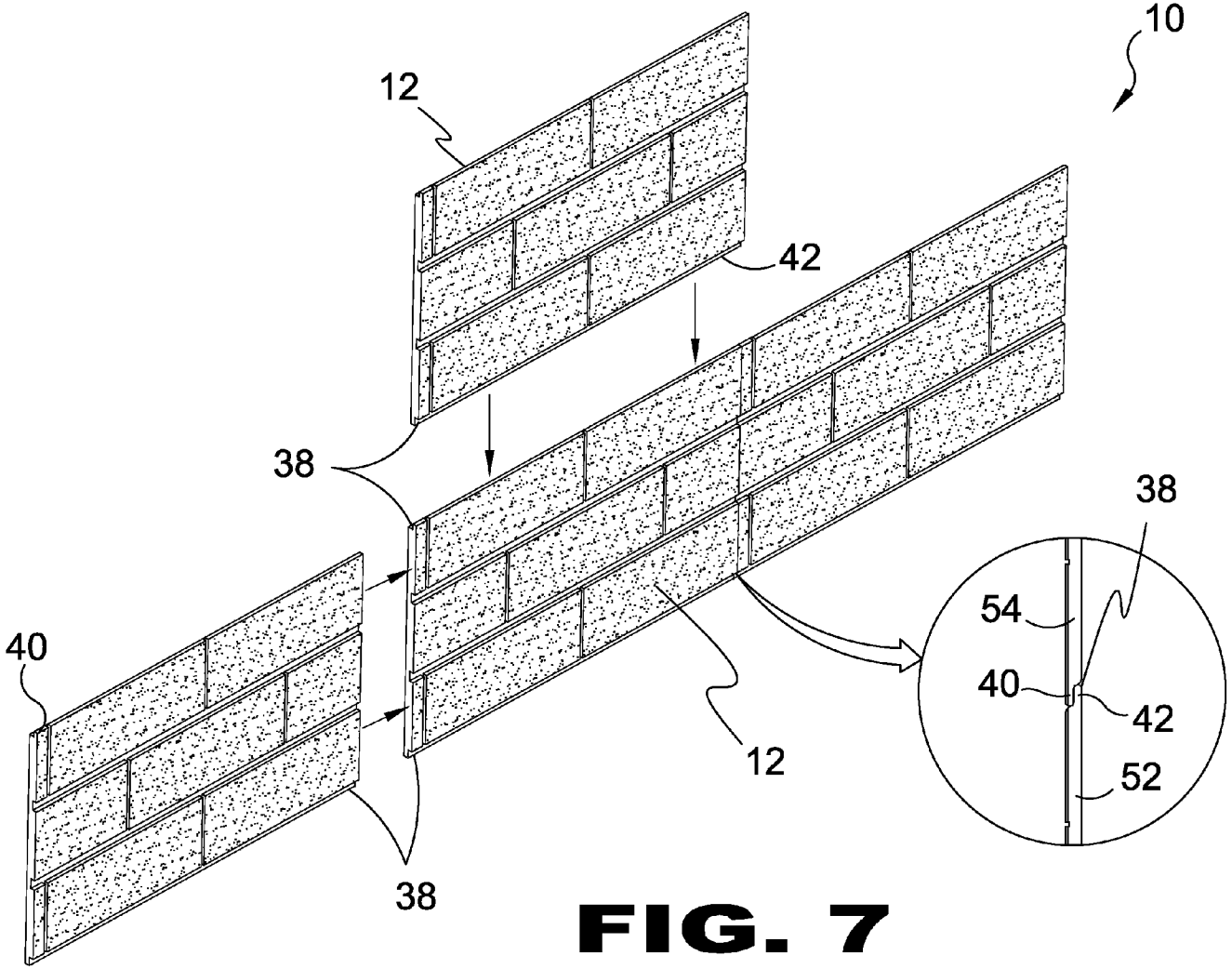
FIG. 7 is a perspective view of the present invention in use.

FIG. 7 is a perspective view of the present invention 10 in use. Shown is the present invention 10 having a first course 52 of boards 12 installed and a second course 54 ready for installation by mating the overlap 40 of the first course 52 with the underlap 42 of the second 54 to form a vertically overlapped joint 38.

Figure 8:
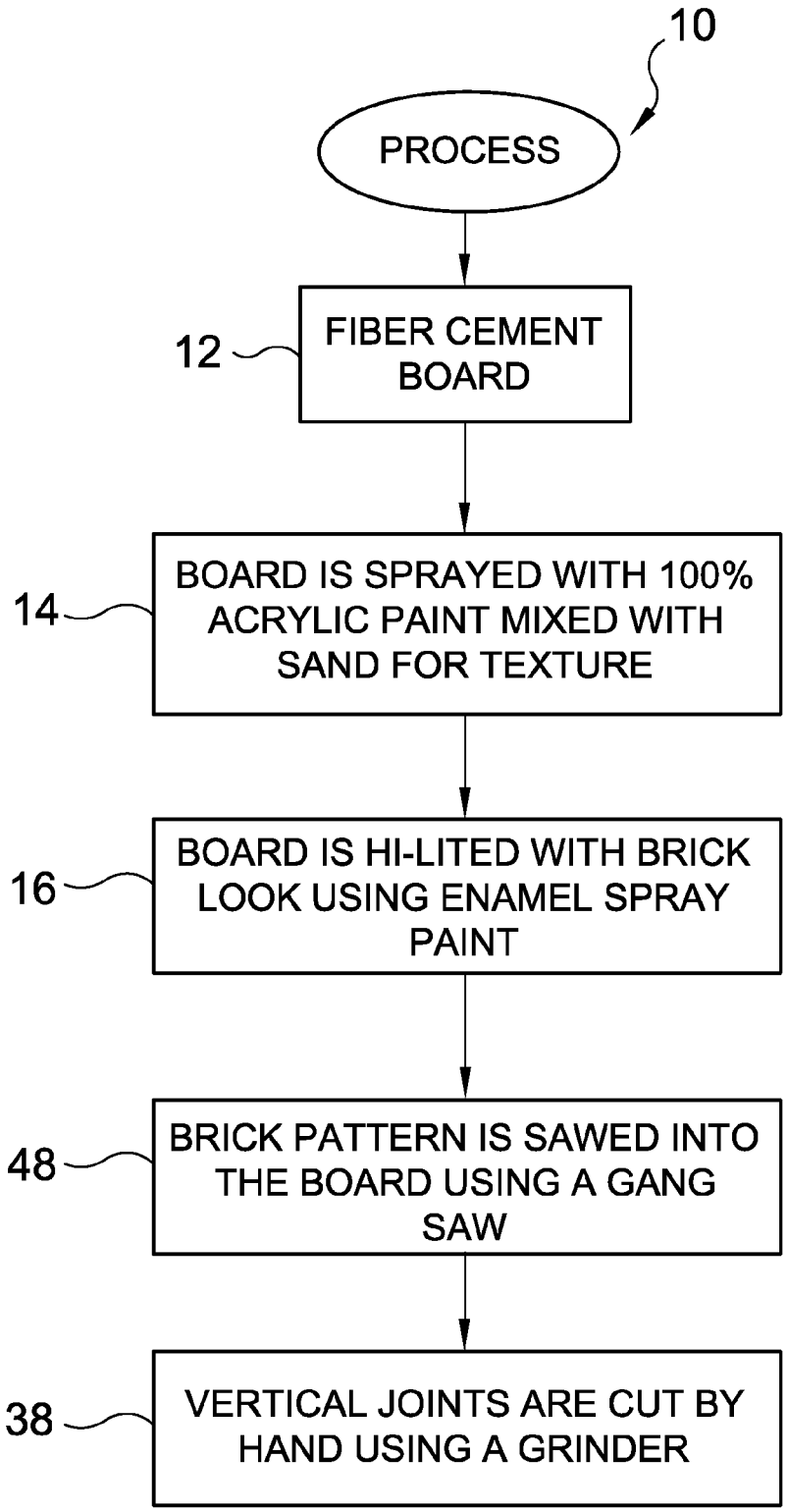
FIG. 8 is a chart of the process of the present invention.

FIG. 8 is a chart of the process of the present invention 10. Shown is a chart of the process of creating the simulated brick fiber cement board 12 of the present invention 10 by spraying the fiber cement board 12 with acrylic paint mixed with sand 14, then applying enamel spray paint 16 to the board 12, using gang saw cuts 48 to define a brick-like pattern and using a grinder to make the vertically overlapped joints 38.

Figure 9:
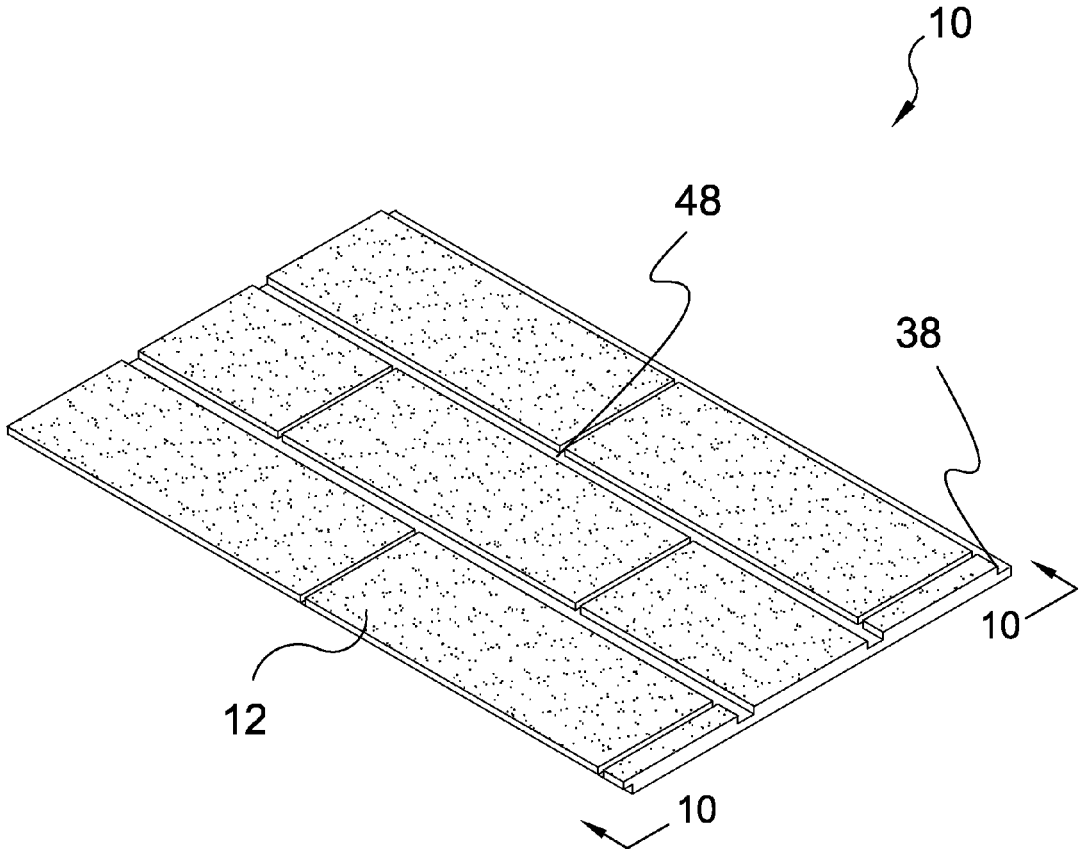
FIG. 9 is a perspective view of the present invention.

FIG. 9 is a perspective view of the present invention 10. Shown is the next step in creating the fiber cement siding of the present invention 10. The brick pattern is sawed producing gang saw cuts 48. The vertically overlapped joints 38 are then hand cut using a grinder. The board 12 is washed down and is now ready for installation.

Figure 10:
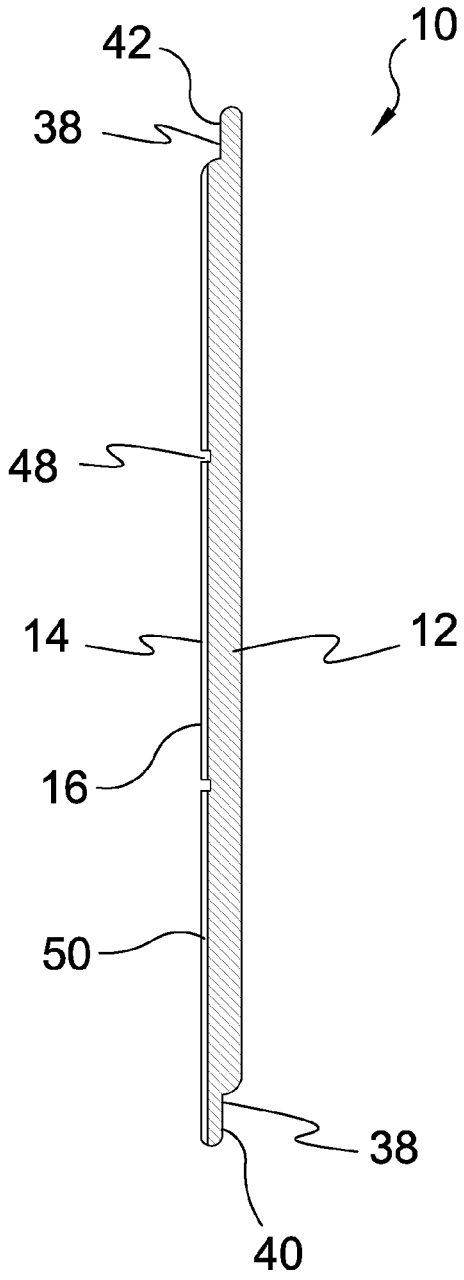
FIG. 10 is a cross sectional view of the present invention.

FIG. 10 is a cross sectional view of the present invention 10 taken from FIG. 9 as indicated. Shown is the cement board 12 having a brick foundation facing 50 sprayed with acrylic paint and sand mixture 14 and enamel paint 16 and scored with gang saw cuts 48. The overlap 40 and underlap 42 of the vertically overlapped joints 38 are hand cut using a grinder.

Figure 11:
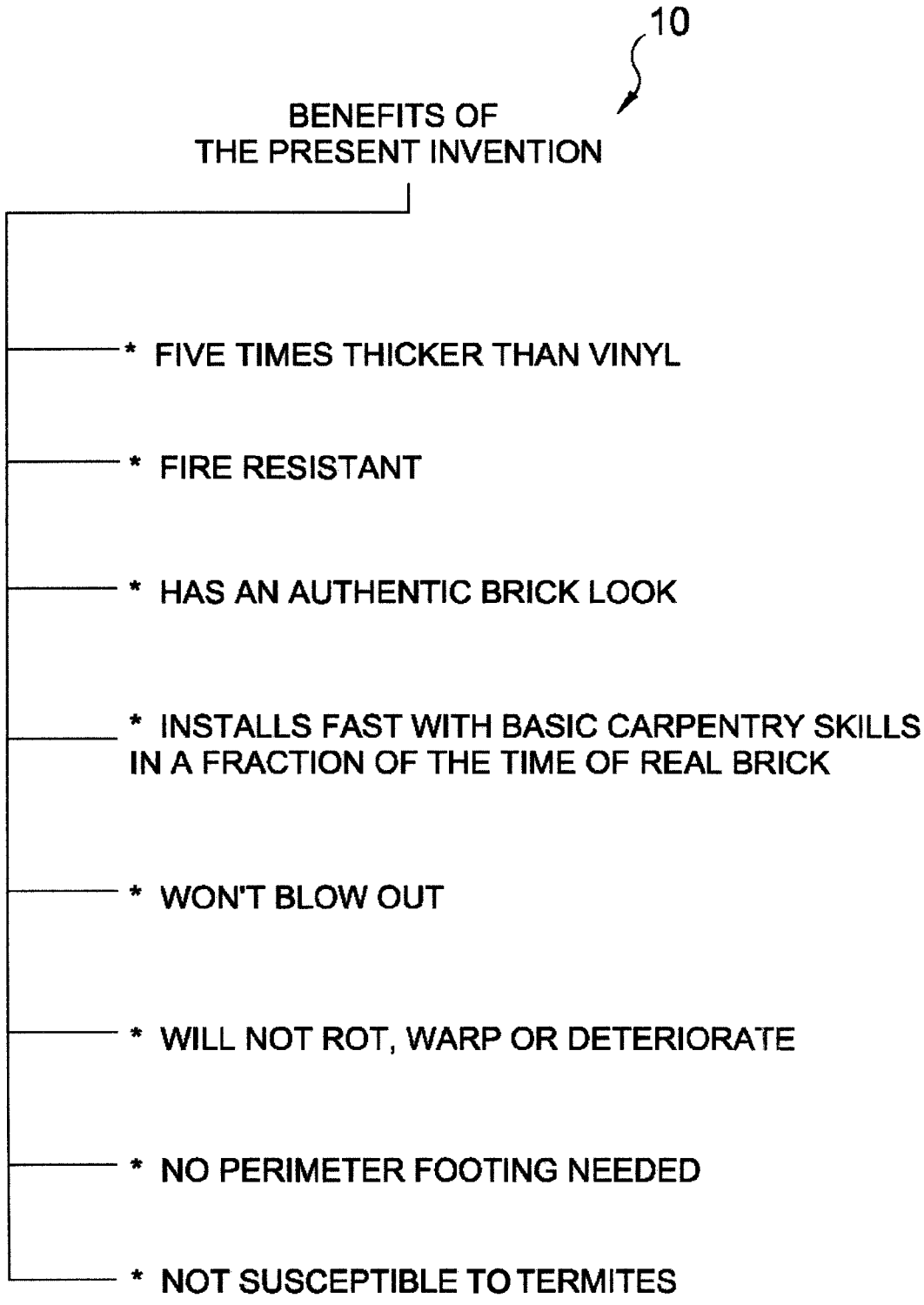
FIG. 11 is a chart of the attributes of the present invention.

FIG. 11 is a chart of the attributes of the present invention 10. Shown is a chart demonstrating the advantages and the benefits of the simulated brick panel of the present invention 10.

Figure 12:
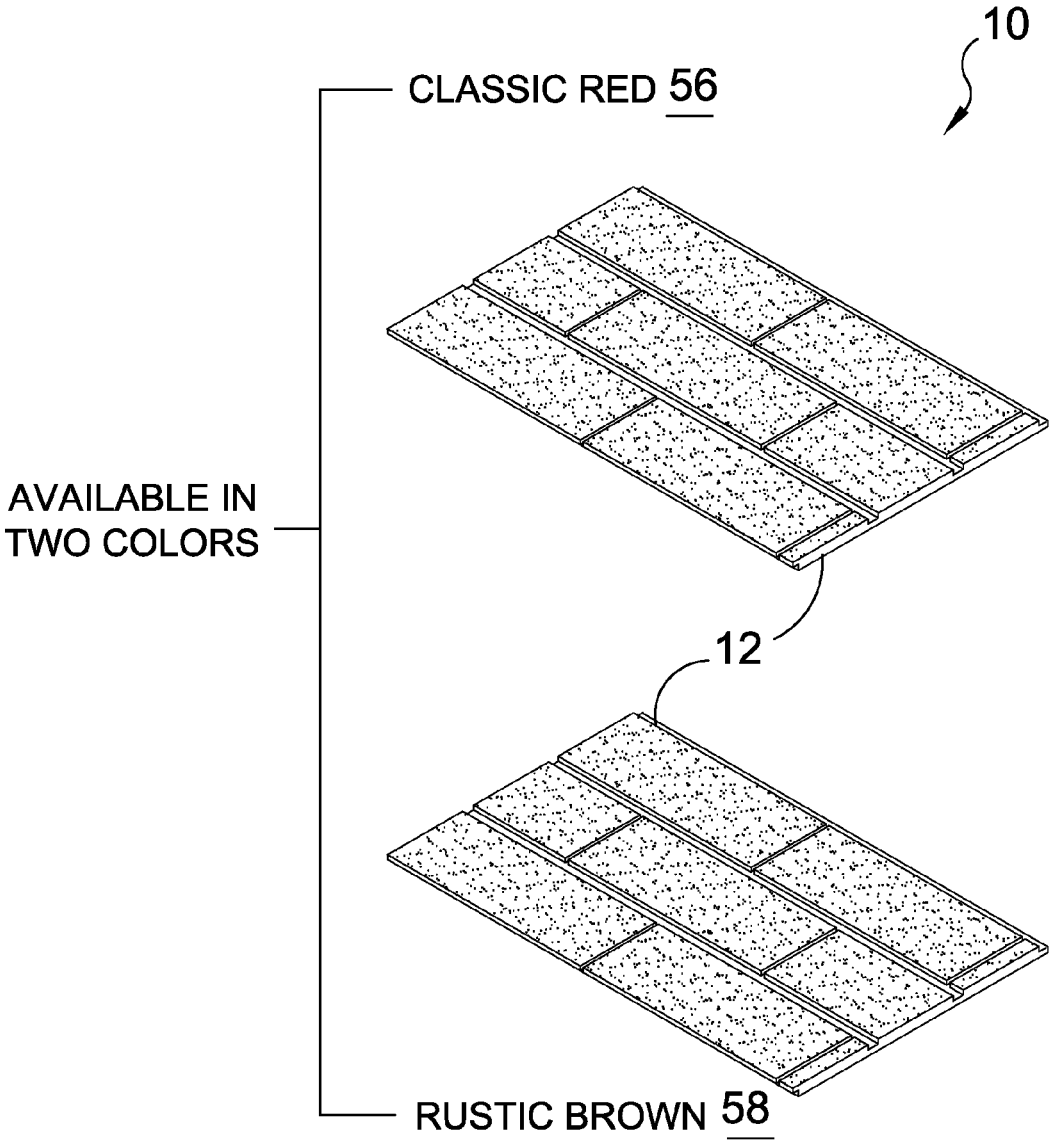
FIG. 12 is an illustrative view of the present invention.

FIG. 12 is an illustrative view of the present invention 10. The finished cement board 12 is available in at least two colors which include a classic red finish 56 and a rustic brown finish 58.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A simulated brick building panel consisting essentially of:

a) a substantially rectangular fiber cement board;

b) an acrylic paint and sand mixture sprayed onto a facing of said cement board to provide texture to a finish on the facing of the cement board;

c) enamel paint sprayed over said acrylic paint and sand mixture to highlight the brick effect;

d) the cement board having opposed vertical edges and opposed horizontal edges, wherein the horizontal edges have a length that is greater than a length of the vertical edges;

e) a plurality of faux mortar lines created by scoring the surface of said finish, wherein said faux mortar lines define a plurality of bricks on the facing of the cement board, the plurality of bricks forming exactly three stacked courses on the facing of the cement board, the courses are stacked in the direction of the vertical edges; and f) the plurality of bricks includes a plurality of full bricks and a plurality of partial bricks; where the opposed vertical edges include only partial bricks and the full bricks are disposed intermediate the vertical edges.

2. The simulated brick building panel recited in claim 1, wherein said faux mortar lines are scored using gang saw cuts.

3. The simulated brick building panel recited in claim 2, wherein said cement board further includes vertically overlapped joints for mating a superior course to an inferior course.

4. The simulated brick building panel recited in claim 3, wherein each said cement board has an overlap on one edge and an underlap on the opposing edge thereby enabling an installer to form said vertically overlapped joint by mating the overlap of one board with the underlap of the other.

5. The simulated brick building panel recited in claim 4, wherein said overlap and said underlap of said vertical joint are hand cut using a grinder.

6. The simulated brick building panel recited in claim 5, wherein said facing of said cement board is washed to remove residue accumulated thereon during cutting and grinding.

7. The simulated brick building panel recited in claim 6, wherein installation of the finished cement boards is accomplished by nailing or screwing said boards to nailers with each said board butted against the adjacent board and adding additional courses as needed by mating the overlap and underlap of the vertical joints.

8. The simulated brick building panel recited in claim 1, wherein the finish on said facing is available in a plurality of colors.

9. The simulated brick building panel recited in claim 8, wherein the color finishes are selected from the group of classic red and rustic brown.

10. The simulated brick building panel recited in claim 1, wherein variations in the brick-like color and texture are provided by varying the acrylic paint color and sand particle size and density.

* * * * *